US008402604B2

(12) United States Patent
Dant

(10) Patent No.: US 8,402,604 B2
(45) Date of Patent: Mar. 26, 2013

(54) COMBINED CREVICE TOOL AND DUSTING BRUSH

(75) Inventor: Ryan T. Dant, Richmond, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 355 days.

(21) Appl. No.: 12/875,726

(22) Filed: Sep. 3, 2010

(65) Prior Publication Data

US 2012/0054979 A1 Mar. 8, 2012

(51) Int. Cl.
*A47L 9/02* (2006.01)

(52) U.S. Cl. ..... 15/416; 15/373; 15/400

(58) Field of Classification Search ..... 15/373, 15/400, 416, 417; *A47L 9/02*
See application file for complete search history.

(56) References Cited

U.S. PATENT DOCUMENTS

| | | | | |
|---|---|---|---|---|
| 2,048,273 | A * | 7/1936 | Ljungquist | 15/416 |
| 2,811,738 | A | 11/1957 | Gall | |
| 2,885,717 | A * | 5/1959 | Lampe | 15/417 |
| 3,048,877 | A * | 8/1962 | Descarries | 15/417 |
| 4,506,406 | A | 3/1985 | LaMonte | |
| 5,502,870 | A | 4/1996 | Ragner et al. | |
| 5,652,997 | A | 8/1997 | Na | |
| 6,792,645 | B2 | 9/2004 | Ruff | |
| 6,820,305 | B2 | 11/2004 | Albert et al. | |

* cited by examiner

*Primary Examiner* — David Redding
(74) *Attorney, Agent, or Firm* — King & Schickli, PLLC

(57) ABSTRACT

A combined crevice tool and dusting brush includes a main body having a first end including a first suction inlet, a side wall including a second suction inlet, a second end including a discharge outlet and an internal air path. The combined tool and brush further includes a valve body that is received in that air path. The valve body includes a closed end, a discharge end including a discharge opening and a wall including a suction opening. The discharge opening is aligned with the discharge outlet. Further, the valve body is displaceable between two different operating positions.

22 Claims, 7 Drawing Sheets

COMBINED CREVICE TOOL AND DUSTING BRUSH

TECHNICAL FIELD OF THE INVENTION

The present invention relates generally to the floor care equipment field and more particularly to a combined crevice tool and dusting brush as well as to a vacuum cleaner equipped with said tool and brush.

BACKGROUND OF THE INVENTION

It has long been known in the art to equip vacuum cleaners with cleaning wands that receive various attachments adapted for particular specialty cleaning needs. For example, elongated crevice tools are well known in the art for cleaning tight spaces. Alternatively, dusting brushes are well known for special dusting purposes including the dusting and cleaning of drapes and upholstery.

The present invention relates to a combined crevice tool and dusting brush that is small, lightweight and convenient to use while also providing excellent cleaning efficiency. The combined crevice tool and dusting brush of the present invention is particularly adapted for use with an upright vacuum cleaner but it should be appreciated that it could also be used with a canister vacuum cleaner if desired.

SUMMARY OF THE INVENTION

In accordance with the purposes of the present invention as described herein a combined crevice tool and dusting brush is provided. The combined crevice tool and dusting brush comprises a main body having a first end including a first suction inlet, a side wall including a second suction inlet, a second end including a discharge outlet and an internal air path. The combined tool and brush further includes a valve body received in that air path. The valve body includes a closed end, a discharge end including a discharge opening and a wall including a suction opening. The discharge opening is aligned with the discharge outlet and the valve body is displaceable between a first position wherein the suction opening is in fluid communication with the first suction inlet and a second position wherein the suction opening is in fluid communication with the second suction inlet.

The combined tool and brush further includes a valve guide that is provided in the main body. The valve guide includes a first flow opening communicating with the first suction inlet and a second flow opening communicating with the second suction inlet. The valve guide includes a wall having a concavity. The second flow opening is formed in that wall in the concavity. Together, a portion of the main body sidewall adjacent the second suction inlet and the concavity define a conically shaped opening. The valve body nests or seats in that conically shaped opening.

In addition, an actuator is connected to the valve body. The actuator comprises a ring received around the side wall of the main body and the actuator is connected to the valve body through an opening or window in the side wall. The operator uses the actuator to rotate the valve body relative to the main body so as to allow selective positioning of the valve body in the first or second position.

In accordance with yet another aspect of the present invention a vacuum cleaner is provided. The vacuum cleaner comprises a housing, a dirt collection vessel carried on the housing and a suction generator carried on the housing. A cleaning wand is connected to the suction generator. Further the vacuum cleaner includes the combined crevice tool and dusting brush.

In the following description there is shown and described several different embodiments of the invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated herein and forming a part of the specification, illustrate several aspects of the present invention and together with the description serve to explain certain principles of the invention. In the drawings.

Figure 2:
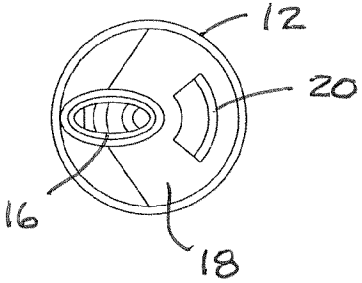
FIG. 2 is an end elevational view of the combined tool and brush illustrated in FIG. 1.
Figure 1:
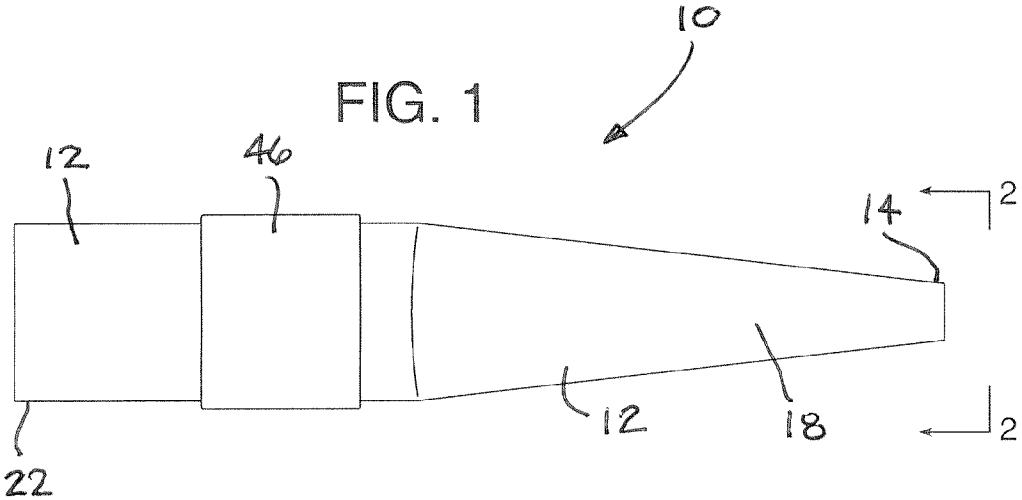
FIG. 1 is a first side elevational view of the combined crevice tool and dusting brush of the present invention.
Figure 3:
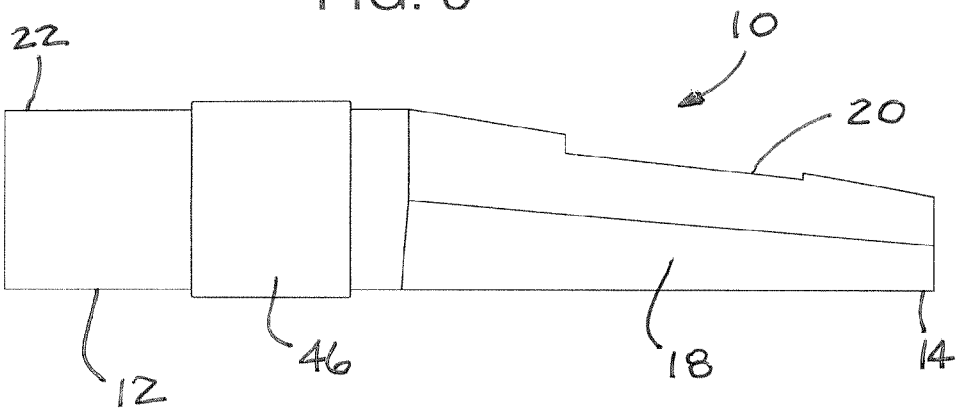
FIG. 3 is a second side elevational view of the combined tool and brush of FIG. 1 with the device rotated 90° about its longitudinal centerline axis.

Reference will now be made in detail to the present preferred embodiment of the invention, examples of which are illustrated in the accompanying drawings.

DETAILED DESCRIPTION OF THE INVENTION

Reference is now made to drawing FIGS. 1-9 illustrating the combined crevice tool and dusting brush 10 of the present invention. As illustrated, the combined tool and brush 10 includes a main body 12 having a first end 14 including a first suction inlet 16, a side wall 18 including a second suction inlet 20 and a second end 22 including a discharge outlet 24. As illustrated, the first end 14 and first suction inlet 16 are elliptical in cross section while the second end 22 and discharge outlet 24 are circular in cross section. An internal air path 26 is defined within the main body 12 between the first end 14 and second end 22. A series of bristle tufts 25 may be provided in the sidewall 18 around the second suction inlet 20 (note bristle tufts are only illustrated in FIG. 4).

A valve body 28 is received in the main body 12 in the air path 26. The valve body 28 includes a closed end 30, a discharge end 32 including a discharge opening 34 and a wall 36 including a suction opening 38. The combined tool and brush 10 further includes a valve guide 40. The valve guide 40 includes a wall 41 defining a first flow opening 42 and a second flow opening 44. More specifically, the wall 41 includes a concavity 43 and the second flow opening 44 is provided in that concavity. The valve guide 40 is provided in the main body 12 so that the first flow opening 42 is in fluid communication with the first suction inlet 16 and the second flow opening 44 is in fluid communication with the second suction inlet 20. In this position, the concavity 42 in the valve guide 40 and the portion of the main body sidewall 18 adjacent the second suction inlet 20 function together to define a conically shaped opening or seat 45. When properly positioned and seated in the main body 12, the valve body 28 nests or seats in this conically shaped opening 45. Thus, the discharge opening 34 in the valve body 28 is aligned with the discharge outlet 24 of the main body 12. Significantly, however, the valve body 28 is selectively displaceable between a first position wherein the suction opening 38 is provided in fluid communication with the first suction inlet 16 and a second position wherein the suction opening is provided in fluid communication with the second suction inlet 20.

More specifically, an actuator 46 is provided to allow the operator to manipulate the valve body 28 between the first and second positions. The actuator 46 is a ring received in a channel 47 provided around the side wall 18 of the main body 12. The actuator 46 is connected to the valve body 28 through an opening or window 48 in the side wall 18. In the illustrated embodiment, the actuator 46 includes a pin 50 and the valve body 28 includes a socket or aperture 52. The pin 50 engages in the socket 52 to complete the connection of the actuator 46 to the valve body 28.

Figure 5:
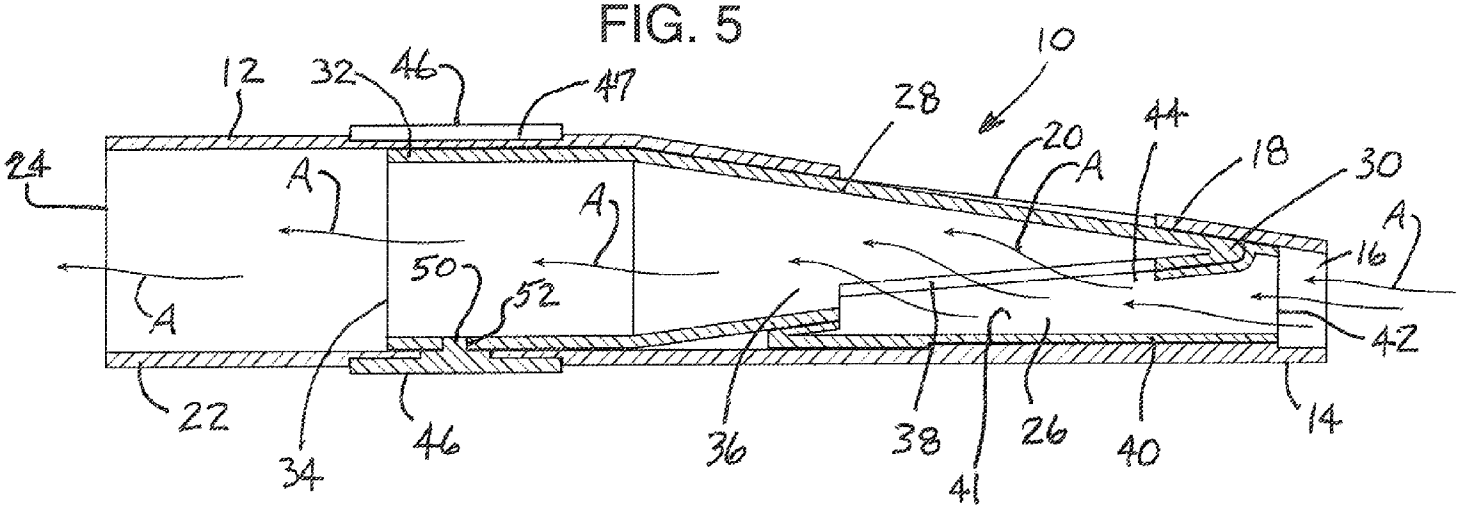
FIG. 5 is a sectional view of the combined tool and brush showing the valve body in the first position.
Figure 6:
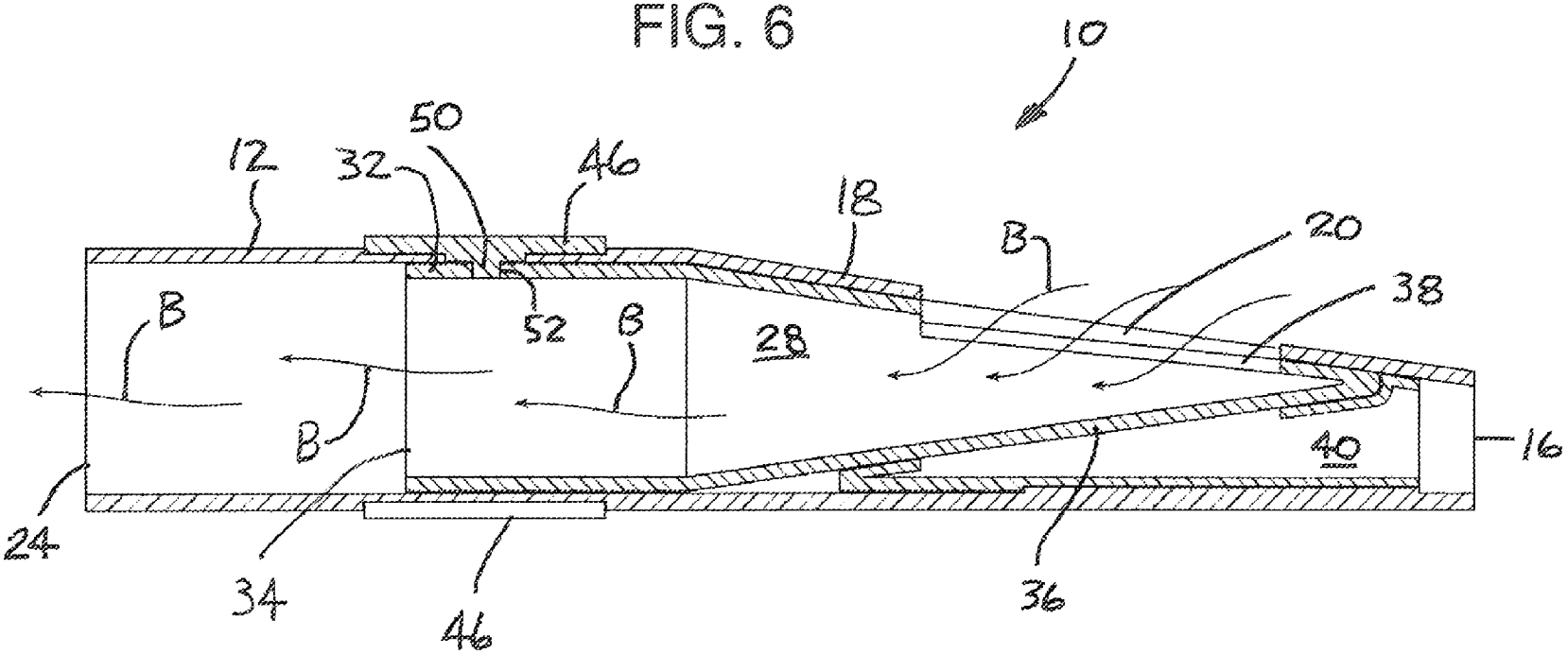
FIG. 6 is a sectional view similar to FIG. 5 illustrating the valve body in the second position.

The pin 50 engages a first edge 54 of the window 48 when the valve body is in the first position (see particularly FIG. 5). Thus, it should be appreciated that the first edge 54 of the window acts as a stop to ensure proper alignment between the suction opening 38 and first suction inlet 36 when the actuator 46 is rotated in a first direction. Similarly, the pin 50 engages a second edge 58 of the window 48 when the actuator 46 is rotated into the second position. This ensures that the suction opening 38 is properly aligned with the second suction inlet 20 when the valve body is in the second position (see particularly FIG. 6).

Figure 4:
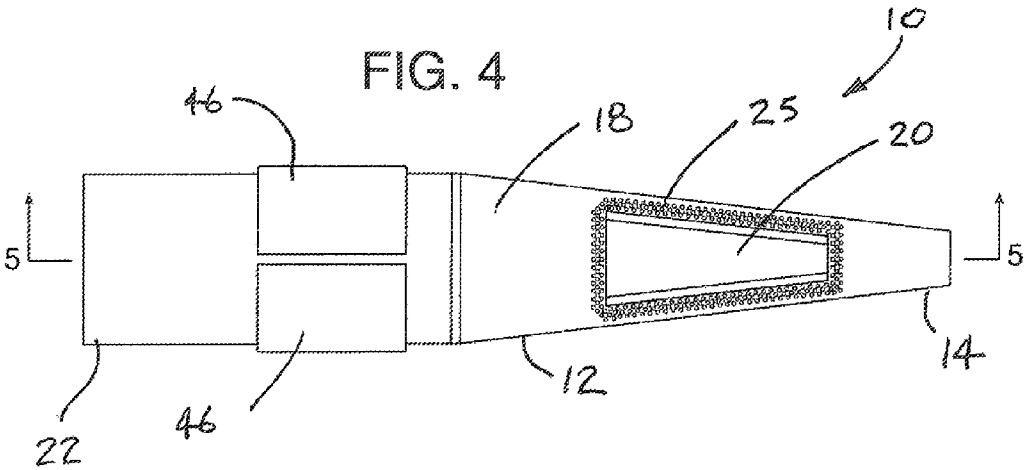
FIG. 4 is yet another side elevational view illustrating the dusting brush suction inlet in the sidewall of the device.

As best illustrated in FIGS. 4 and 5, it should be appreciated that the combined crevice tool and dusting brush 10 has a longitudinal centerline axis A. The first end 14 of the main body 12 is tapered toward the first suction inlet 16. Further, the taper is offset from the longitudinal centerline axis A. It is this unique shaping of the main body 12 and valve body 28 that allows a simple rotary valve to provide an air path for crevice tool cleaning (see action arrows A in FIG. 5) and dusting brush cleaning (see action arrows B in FIG. 6) while allowing selection of the cleaning position by simple rotation of the actuator 46.

The combined crevice tool and dusting brush 10 is relatively easy to assembly. First the valve guide 40 is inserted into the discharge outlet 24 of the main body 12 and positioned against the shoulder 60. The valve guide 40 is held in position in the main body 12 by friction fit, adhesive or other appropriate means (see FIG. 8). Next the valve body 28 is seated in the conically shaped opening 45 formed by the concavity 43 of the valve guide 40 and the inside of the sidewall 18 adjacent the suction inlet 20.

Figure 7:
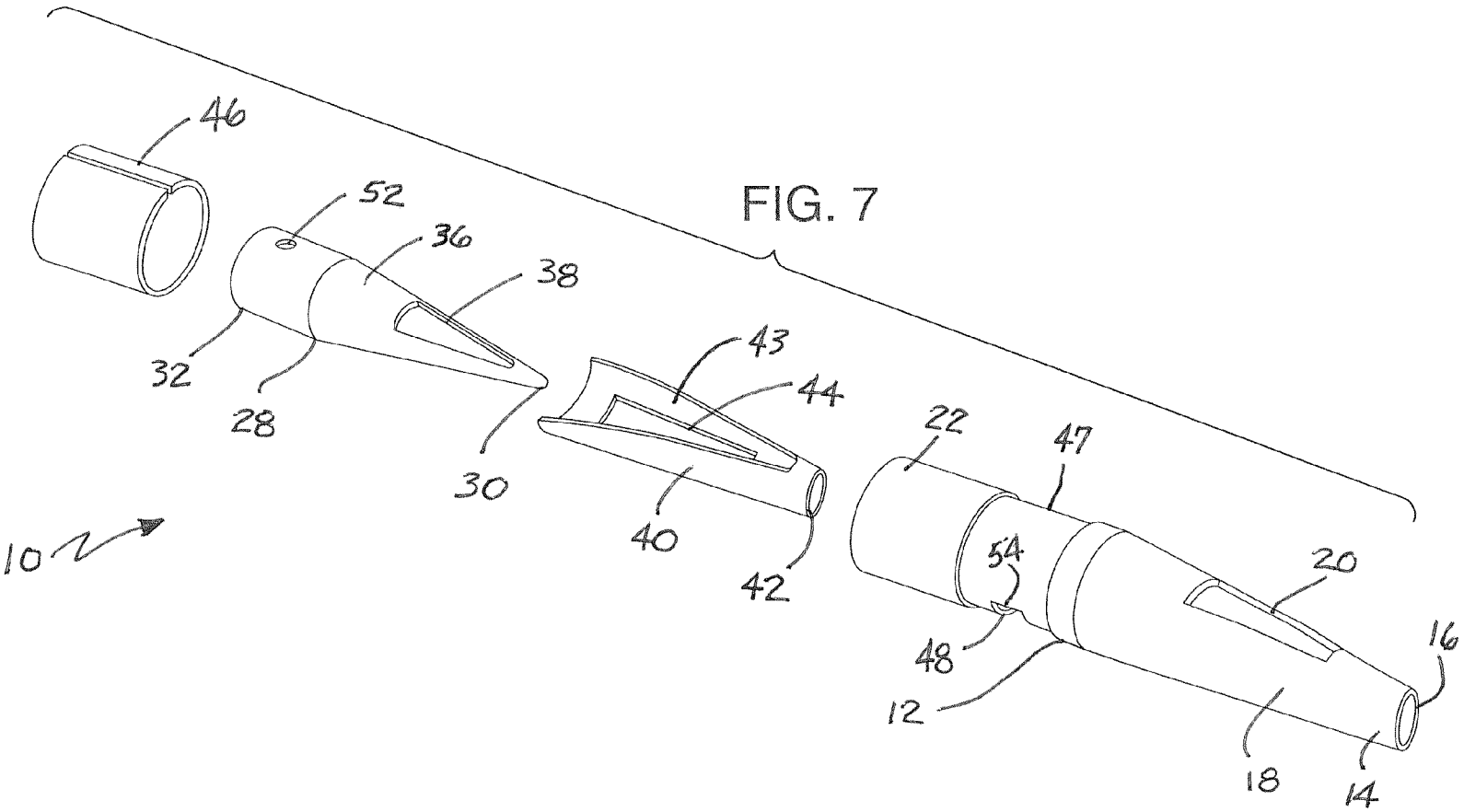
FIG. 7 is an exploded perspective view of the combined tool and brush.
Figure 8:
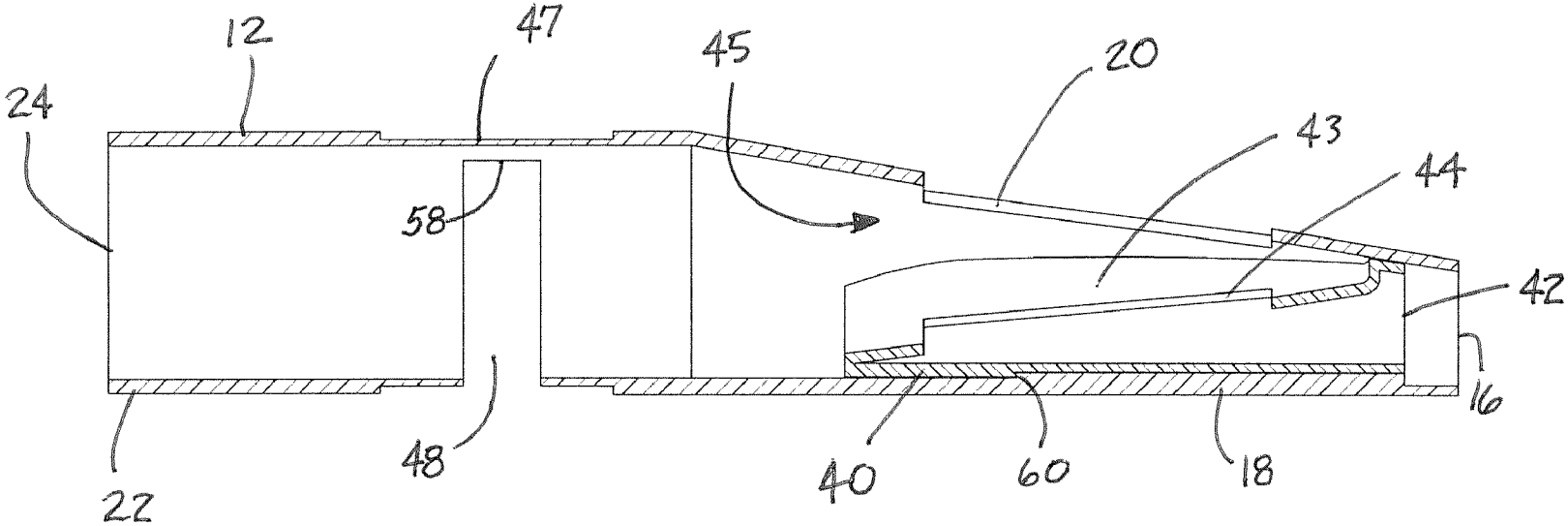
FIG. 8 is a cross sectional view illustrating the mounting of the valve guide in the main body.
Figure 9:
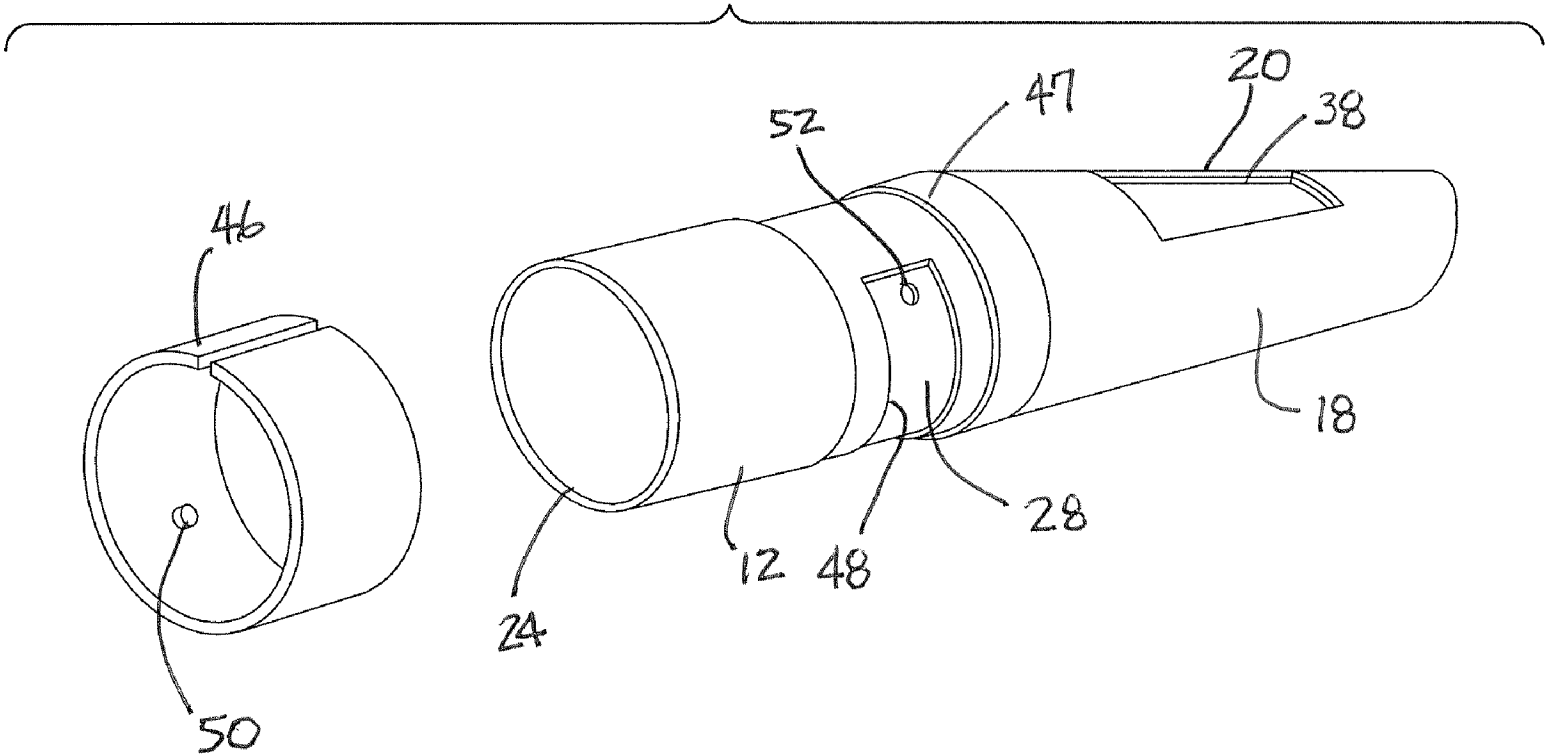
FIG. 9 is a partially exploded perspective view illustrating how the actuator is mounted to the main body so as to engage the valve body.

As illustrated in FIGS. 7 and 9, the actuator 46 is a split ring made from resilient material. The actuator 46 is expanded and passed over the main body 12 until it is aligned with the channel 47. At the same time, the pin 40 on the actuator 46 is aligned with the socket 52 on the valve body 28. The resiliency of the actuator 46 causes the ring to close so that the actuator is trapped in the channel 47 while also being pinned to the valve body 28.

Figure 10:
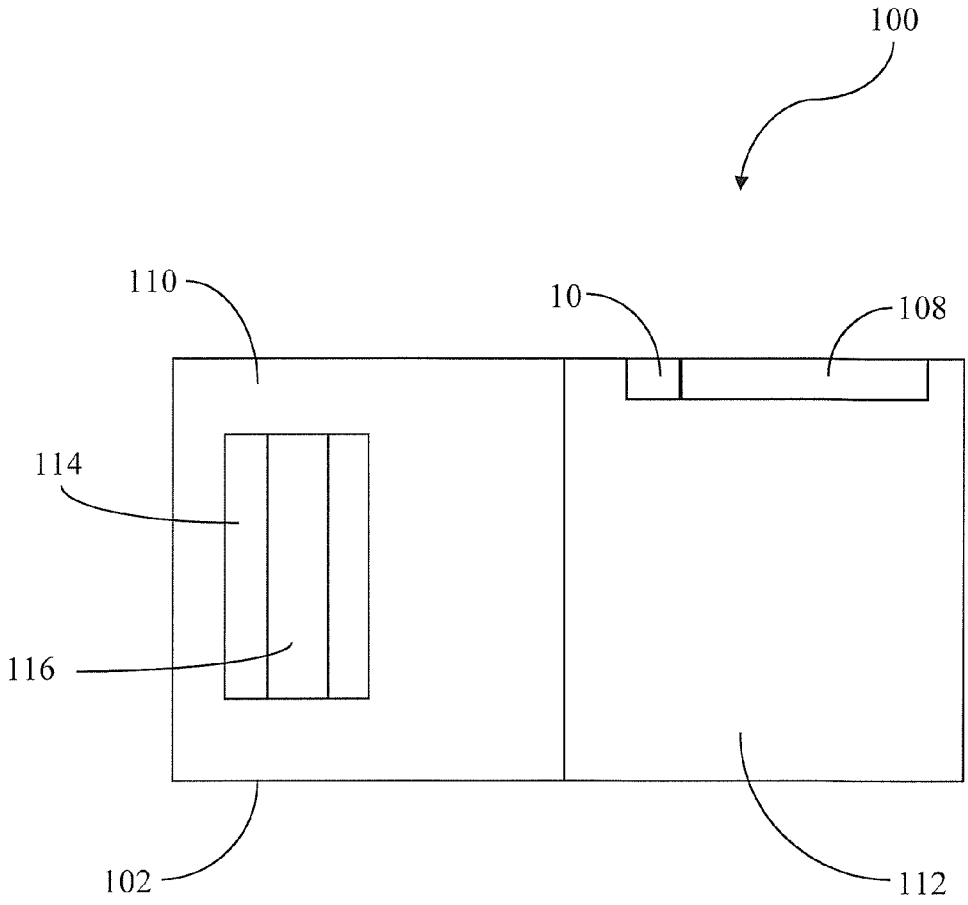
FIG. 10 is a schematical block diagram of a vacuum cleaner equipped with the combined crevice tool and dusting brush of the present invention.

FIG. 10 schematically illustrates an upright vacuum cleaner 100 including a housing 102, a dirt collection vessel 104 carried on the housing and a suction generator 106 carried on the housing. The upright vacuum cleaner 100 further includes a cleaning wand 108 and the combined crevice tool and dusting brush 10 of the present invention.

More particularly, the housing 102 of the upright vacuum cleaner 100 includes a nozzle assembly 110 and a canister assembly 112. The nozzle assembly 110 includes a suction inlet 114 holding a rotary agitator 116. The canister assembly 112 includes an operator handle and operator controls of a type well known in the art. During normal upright vacuum cleaner operation the cleaning wand 108 is maintained in the standard operating position along the side of the canister assembly 112. In contrast, during specialty cleaning, the distal end of the cleaning wand 108 is removed from the storage position along the side of the canister assembly 112. The combined crevice tool and dusting brush 10 of the present invention may then be connected to the distal end of the cleaning wand 108. The operator then manipulates the actuator 46 into either the first position for crevice tool cleaning or the second position for dusting brush cleaning as desired or required for any particular cleaning application. When the special cleaning function is no longer required and the operator desires to return to the standard upright vacuum cleaner operating mode, the combined crevice tool and dusting brush 10 is removed from the distal end of the cleaning wand 108 and stored on the vacuum cleaner 100 and the cleaning wand 108 is returned to the standard operating position along the side of the canister assembly 112.

In summary, numerous benefits result from employing the concepts of the present invention. The combined crevice tool and dusting brush 10 provides two cleaning tools in one thereby reducing vacuum cleaner components. Advantageously, the combined crevice tool and dusting brush 10 is small, lightweight and convenient to use. Further, it provides excellent cleaning efficiency in the first or crevice tool cleaning position and the second or dusting brush cleaning position. It is particularly useful in combination with upright vacuum cleaners which have a limited ability to conveniently store cleaning attachments for use. It should be appreciated, however, that it functions equally well with canister vacuum cleaners.

The foregoing description of the preferred embodiments of the present invention have been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed:

1. A tool, comprising:

a main body having a first end including a first suction inlet, a sidewall including a second suction inlet, a second end including a discharge outlet and an internal air path;

a valve body received in said air path, said valve body including a closed end, a discharge end including a discharge opening and a wall including a suction opening, said discharge opening being aligned with said discharge outlet and said valve body being displaceable between a first position wherein said suction opening is in fluid communication with said first suction inlet and a second position wherein said suction opening is in fluid communication with said second suction inlet; and said tool includes a longitudinal centerline axis A, wherein said first end of said main body is tapered toward said first suction inlet and said taper is offset from said longitudinal axis A.

2. The tool of claim 1, further including an actuator connected to said valve body.

3. The tool of claim 2, wherein said actuator is a ring received around said sidewall of said main body and said actuator is connected to said valve body through an opening in said sidewall.

4. The tool of claim 3, wherein said actuator and said valve body rotate relative to said main body.

5. The tool of claim 1, further including a valve guide provided in said main body.

6. The tool of claim 5, wherein said valve guide includes a first flow opening communicating with said first suction inlet and a second flow opening communicating with said second suction inlet.

7. The tool of claim 6, wherein said valve guide includes a wall having a concavity and said second flow opening is formed in said wall in said concavity.

8. The tool of claim 7, wherein a portion of said sidewall adjacent said second suction inlet and said concavity define a conically shaped opening and said valve body nests in said conically shaped opening.

9. The tool of claim 1, further including a series of bristle tufts carried on said sidewall around said second suction inlet.

10. The tool of claim 1, wherein said first end of said main body has an elliptical cross section.

11. The tool of claim 1, wherein said second end of said main body and said discharge end of said valve body are both circular in cross section and said discharge end is concentrically received in said second end.

12. A vacuum cleaner comprising:

a housing;

a dirt collection vessel carried on said housing;

a suction generator carried on said housing;

a cleaning wand connected to said suction generator; and a combined crevice tool and dusting brush including:

a main body having a first end including a first suction inlet, a sidewall including a second suction inlet, a second end including a discharge outlet and an internal air path;

a valve body received in said air path, said valve body including a closed end, a discharge end including a discharge opening and a wall including a suction opening, said discharge opening being aligned with said discharge outlet and said valve body being displaceable between a first position wherein said suction opening is in fluid communication with said first suction inlet and a second position wherein said suction opening is in fluid communication with said second suction inlet and said tool includes a longitudinal centerline axis A, wherein said first end of said main body is tapered toward said first suction inlet and said taper is offset from said longitudinal axis A.

13. The vacuum cleaner of claim 12, further including an actuator connected to said valve body.

14. The vacuum cleaner of claim 13, wherein said actuator is a ring received around said sidewall of said main body and said actuator is connected to said valve body through an opening in said sidewall.

15. The vacuum cleaner of claim 14, wherein said actuator and said valve body rotate relative to said main body.

16. The vacuum cleaner of claim 12, further including a valve guide provided in said main body.

17. The vacuum cleaner of claim 16, wherein said valve guide includes a first flow opening communicating with said first suction inlet and a second flow opening communicating with said second suction inlet.

18. The vacuum cleaner of claim 17, wherein said valve guide includes a wall having concavity and said second flow opening is formed in said wall in said concavity.

19. The vacuum cleaner of claim 18, wherein a portion of said sidewall adjacent said second suction inlet and said concavity define a conically shaped opening and said valve body nests in said conically shaped opening.

20. The vacuum cleaner of claim 12, further including a series of bristle tufts carried on said sidewall around said second suction inlet.

21. The vacuum cleaner of claim 12, wherein said first end of said main body has an elliptical cross section.

22. The vacuum cleaner of claim 12, wherein said second end of said main body and said discharge end of said valve body are both circular in cross section and said discharge end is concentrically received in said second end.

* * * * *